US011398700B2

(12) United States Patent
Lin

(10) Patent No.: US 11,398,700 B2
(45) Date of Patent: Jul. 26, 2022

(54) SAFE ELECTRICAL CONNECTOR HAVING REPLACEABLE INTERFACE

(71) Applicant: SHENZHEN LINKO ELECTRIC CO., LTD., Guangdong (CN)

(72) Inventor: Shunhua Lin, Guangdong (CN)

(73) Assignee: SHENZHEN LINKO ELECTRIC CO., LTD., Shenzhen (CN)

( * ) Notice: Subject to any disclaimer, the term of this patent is extended or adjusted under 35 U.S.C. 154(b) by 0 days.

(21) Appl. No.: 17/169,706

(22) Filed: Feb. 8, 2021

(65) Prior Publication Data

US 2021/0167548 A1 Jun. 3, 2021

Related U.S. Application Data

(63) Continuation of application No. PCT/CN2018/098302, filed on Aug. 2, 2018.

(30) Foreign Application Priority Data

Jul. 4, 2018 (CN) ..... 201810726171.0

(51) Int. Cl.

| | |
|---|---|
| ***H01R 13/627*** | (2006.01) |
| ***H01R 13/506*** | (2006.01) |
| ***H01R 13/52*** | (2006.01) |
| ***H01R 13/631*** | (2006.01) |

(Continued)

(52) U.S. Cl.

CPC ..... *H01R 13/6271* (2013.01); *H01R 13/506* (2013.01); *H01R 13/5205* (2013.01); *H01R 13/631* (2013.01); *H01R 13/6456* (2013.01); *H01R 27/02* (2013.01)

(58) Field of Classification Search

None

See application file for complete search history.

(56) References Cited

U.S. PATENT DOCUMENTS

2009/0185777 A1* 7/2009 Ziemke ..... H01R 13/639 385/56
2015/0229075 A1* 8/2015 Lin ..... H01R 13/633 439/153

FOREIGN PATENT DOCUMENTS

CN 204333449 U 5/2015
CN 207572678 U 7/2018

OTHER PUBLICATIONS

International Search Report of PCT Patent Application No. PCT/CN2018/098302 dated Apr. 10, 2019.

* cited by examiner

*Primary Examiner* — Oscar C Jimenez

(57) ABSTRACT

The present invention discloses a safe electrical connector that has a replaceable interface, the electrical connector comprises a plug assembly and a socket assembly, wherein the plug assembly comprises a plug housing and a plug core connecting wire fixing body, the plug housing is internally provided with plug core accommodating cavities, and there are a plurality of plug core accommodating cavities; an existing plug core may be detachably mounted inside of a plug core accommodating cavity, and a connecting wire of the existing plug core penetrates from an upper end of the plug housing; the plug core connecting wire fixing body fixes the connecting wire on the plug housing; the socket assembly comprises a socket housing, the socket housing is internally provided with plug core female end accommodating cavities, and the plug core female end accommodating cavities are adapted to the plug core accommodating cavities.

16 Claims, 9 Drawing Sheets

(51) Int. Cl.
*H01R 13/645* (2006.01)
*H01R 27/02* (2006.01)

SAFE ELECTRICAL CONNECTOR HAVING REPLACEABLE INTERFACE

CROSS REFERENCE TO RELATED APPLICATIONS

The present application is a Continuation Application of PCT Application No. PCT/CN2018/098302 filed on Aug. 2, 2018, which claims the benefit of Chinese Patent Application No. 201810726171.0 filed on Jul. 4, 2018. All the above are hereby incorporated by reference in their entirety.

TECHNICAL FIELD

The present invention belongs to the field of connectors, and particularly relates to a safe electrical connector having replaceable interface.

BACKGROUND ART

Existing connectors and connecting terminals all have one plug core, which can only be connected to a specific data line/power line. Although the existing connectors and connecting terminals are provided with a plurality of plugging female ends, a single plug core or a machine-available plug core is often used in order to save space and in consideration of their own costs. With the continuous increase of intelligent devices, in cases where some testing devices or specific precision devices in production activities need to work in different regions or need to be stored after work, some power lines, network cables or specific data lines need to be plugged and unplugged each time they are used, and each line needs to be plugged each time, so the amount of repetition is large. In activities such as commercial exhibitions, many devices are used, the connection lines thereof are connected at single positions, so that there will be many connections and repeated check is required after connection, so more time is consumed, and the connection effect is poor.

For that, the applicant, in patent CN201420822631.7, discloses a plug and socket integrated connector compatible with board-to-board butt joints. This connector includes a plug, a socket, a box, a movable plate for correcting installation positions of the plug and the socket, and a plurality of guide pillars distributed symmetrically and used to guide the correction of the positions of the plug and the socket. A bottom end of the plug penetrates the box and then is fixedly connected to the socket, and a bottom end of the socket is inserted into the movable plate. One end of each of a plurality of guide pillars is fixed on two sides of the plug, and the other end of each of a plurality of guide pillars penetrates through the holes on two sides of the box and the socket in turn and then are inserted into two sides of the movable plate.

Although different plug cores can be provided in the above-mentioned patent, ordinary users cannot replace different plug cores, and need to purchase new plug cores when they need to use different plug cores. However, not all plug cores have integrated collectors, so it takes the users a long time to wait for factory customization.

SUMMARY OF THE INVENTION

In order to solve the above problems, the present invention provides an easy-to-use safe electrical connector having replaceable interface.

Another objective of the present invention is to provide a safe electrical connector having replaceable interface. The electrical connector is strong in versatility, easy to machine, reliable and stable in connection, easy to plug and unplug, and easy to promote.

In order to achieve the above objectives, the technical solution of the present invention is as follows:

A safe electrical connector having replaceable interface, the electrical connector includes a plug assembly and a socket assembly, the plug assembly includes a plug housing and a plug core connecting wire fixing body, the plug housing is internally provided with plug core accommodating cavities, and there are a plurality of plug core accommodating cavities; an existing plug core may be detachably mounted inside of a plug core accommodating cavity, and a connecting wire of the existing plug core penetrates from an upper end of the plug housing; the plug core connecting wire fixing body fixes the connecting wire on the plug housing; the socket assembly comprises a socket housing, the socket housing is internally provided with plug core female end accommodating cavities, and the plug core female end accommodating cavities are adapted to the plug core accommodating cavities.

The plug core accommodating cavities are provided in the plug assembly, and different plug cores can be mounted in the plug core accommodating cavities, so that users can replace different plug cores for use; the electrical connector has high versatility, the model does not need to be separately confirmed again when in use, connectors of specific models do not need to be customized, and different electrical appliances can be connected according to the needs during processing and production. With the plurality of plug core accommodating cavities, a plurality of connecting terminals of some electrical appliances that require multiple connection terminals are integrated to one plug, which improves operation efficiency and reduces error rate.

Further, the electrical connector further includes a plug and unplug clamping assembly, the socket housing is provided with a clamping position, the plug and unplug clamping assembly is mounted on the plug housing, and the plug and unplug clamping assembly is clamped in the clamping position.

The connector is easy to operate, can be plugged or unplugged by one action, has low technical requirements for operators, can be operated in a small and dark space, and has low environmental requirements.

Further, the plug and unplug clamping assembly includes a hand grip and an elastic clamping body, the elastic clamping body is provided with a clamping projection, a right end surface of the clamping projection is provided with a clamping plane, the clamping projection is clamped in the clamping position, the clamping plane is affixed to an inner side of the clamping position, the plug housing is provided with a clamping body accommodating groove, the elastic clamping body is mounted in the clamping body accommodating groove, and the clamping projection is pressed into the clamping body accommodating groove when the hand grip moves upward.

As the clamping projection is provided, the clamping projection is provided with the clamping plane, and the clamping plane is affixed to the clamping body accommodating groove, the plug cannot be removed in the case of no outward pressure on the hand grip, which avoids unplugging the plug due to dragging and the like.

Further, the electrical connector further includes a wrong-pulling prevention assembly, the wrong-pulling prevention assembly is arranged on the plug and unplug clamping assembly, the plug and unplug clamping assembly and the hand grip are movable, the hand grip is provided with a pull-out position, and when the wrong pulling prevention assembly is moved to the pull-out position, the hand grip can be pulled up.

As the wrong pulling prevention assembly is provided, when the wrong pulling prevention assembly is returned to the pull-out position, the hand grip cannot be pulled out to avoid misoperation by others.

Further, an inner side of the hand grip is provided with an anti-detaching oblique sheet, a lower end of the anti-detaching oblique sheet is connected to a lower part of the hand grip, the anti-detaching oblique sheet is arranged obliquely upward, the plug housing is provided with an anti-detaching groove, and an upper end of the anti-detaching oblique sheet is movable up and down in the anti-detaching groove.

The anti-detaching oblique sheet prevents users from detaching it to damage the structure, and the anti-detaching oblique sheet arranged obliquely upward is easy to assemble.

Further, the electrical connector further includes a fool-proof protruding strip, the fool-proof protruding strip is arranged on the plug housing, or the fool-proof protruding strip is arranged on the hand grip, the socket housing is provided with a fool-proof groove, and the fool-proof protruding strip falls in the fool-proof groove.

Further, the plug housing includes a plug housing body and a plug core mounting seat, the plug core mounting seat is mounted at a lower part of the plug housing body, and the plug core accommodating cavities are provided in the plug core mounting seat.

Further, the plug core accommodating cavity includes a plug core surrounding edge and a plug core positioning convex edge, the plug core positioning convex edge is located at a middle part of the plug core surrounding edge, and an upper part of the plug core positioning convex edge is provided with a plug core fixing hole.

Further, an upper end of the plug housing is provided with a connecting wire passing post, a middle part of the connecting wire passing post is provided with a connecting wire passing hole, the electrical connector is further provided with a sealing ring, the sealing ring is placed in the connecting wire passing hole, the plug core connecting wire fixing body is mounted on an end of the connecting wire passing post, and the plug core connecting wire fixing body presses the sealing ring.

Further, the socket housing includes a fixed seat and a plug core female end mounting seat, the plug core female end accommodating cavities are provided in the plug core female end mounting seat, the plug core female end mounting seat is mounted on the fixed seat, the fixed seat is used to mount the plug core female end mounting seat on an existing device, the plug core female end accommodating cavity includes a plug core female end surrounding edge and a plug core female end positioning edge, the plug core female end positioning edge is arranged on the plug core female end surrounding edge, the plug core female end surrounding edge is provided with a female end fixing hole, and an existing plug core female end is clamped on the female end fixing hole.

The advantages of the present invention are:

Compared with the prior art, in the present invention, the plug core accommodating cavities are provided in the plug assembly, and different plug cores can be mounted in the plug core accommodating cavities, so that users can replace different plug cores for use; the electrical connector has high versatility, the model does not need to be separately confirmed again when in use, connectors of specific models do not need to be customized, and different electrical appliances can be connected according to the needs during processing and production. With the plurality of plug core accommodating cavities, a plurality of connecting terminals of some electrical appliances that require multiple connection terminals are integrated to one plug, which improves operation efficiency and reduces error rate.

BEST MODES FOR CARRYING OUT THE INVENTION

In order to make the objectives, technical solutions, and advantages of the present invention clearer, the following further describes the present invention in detail with reference to the accompanying drawings and embodiments. It should be understood that the specific embodiments described herein are only used for interpreting the present invention, rather than limiting the present invention.

Figure 1:
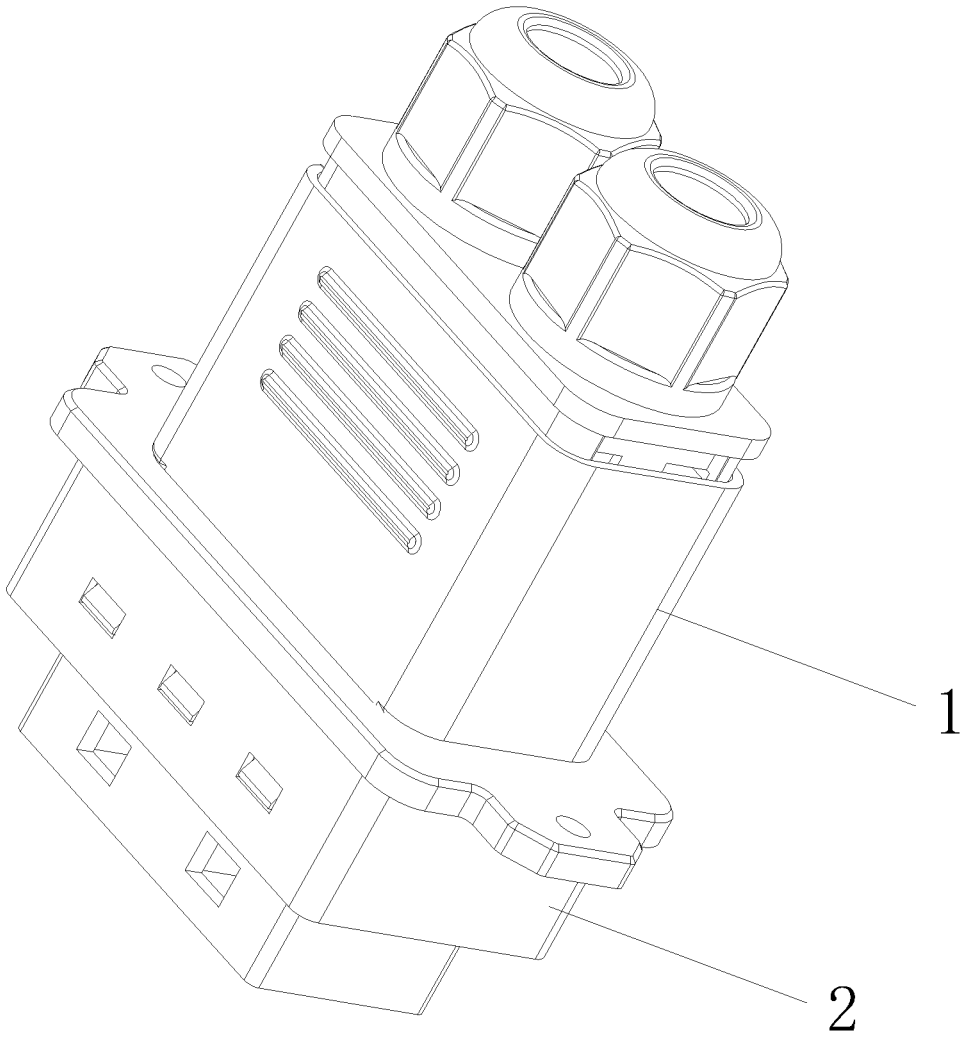
FIG. 1 is a schematic illustration of a safe electrical connector having replaceable interface according to the present invention.
Figure 2:
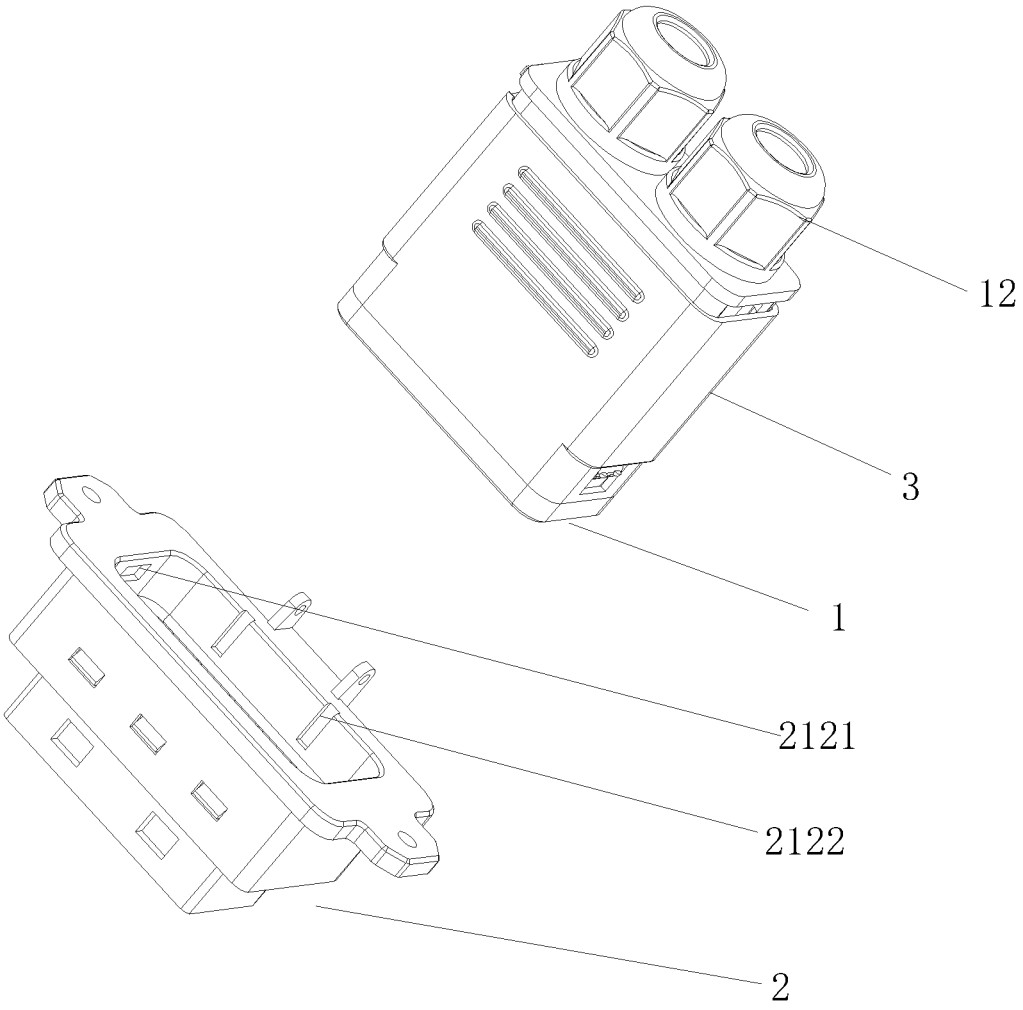
FIG. 2 is a schematic illustration showing the separation of a plug and a socket of the safe electrical connector having replaceable interface according to the present invention.
Figure 3:
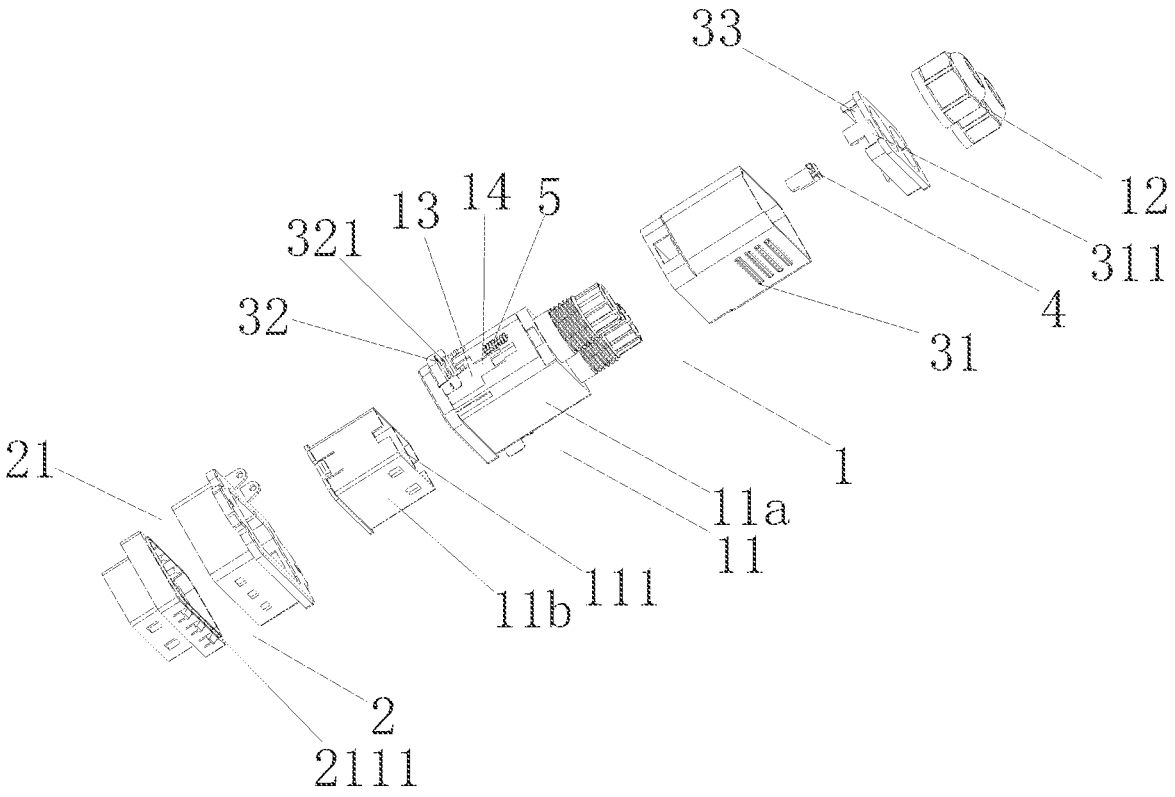
FIG. 3 is an exploded schematic illustration of the safe electrical connector having replaceable interface according to the present invention.
Figure 4:
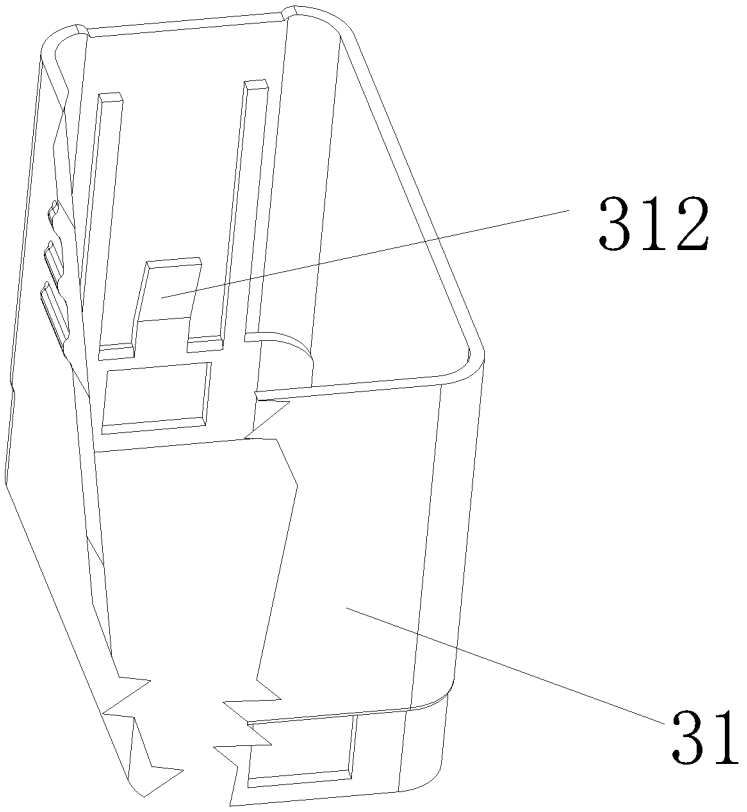
FIG. 4 is a schematic illustration of a hand grip of the safe electrical connector having replaceable interface according to the present invention.
Figure 5:
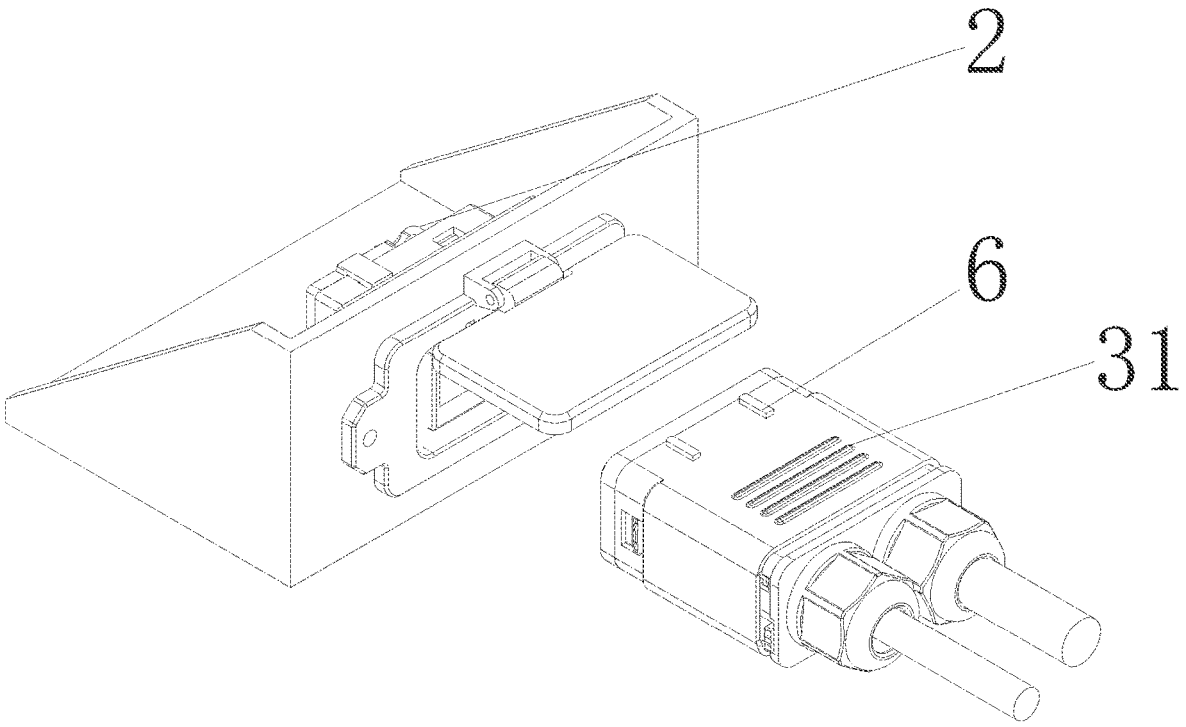
FIG. 5 is an illustration showing a usage state of the safe electrical connector having replaceable interface according to the present invention.
Figure 6:
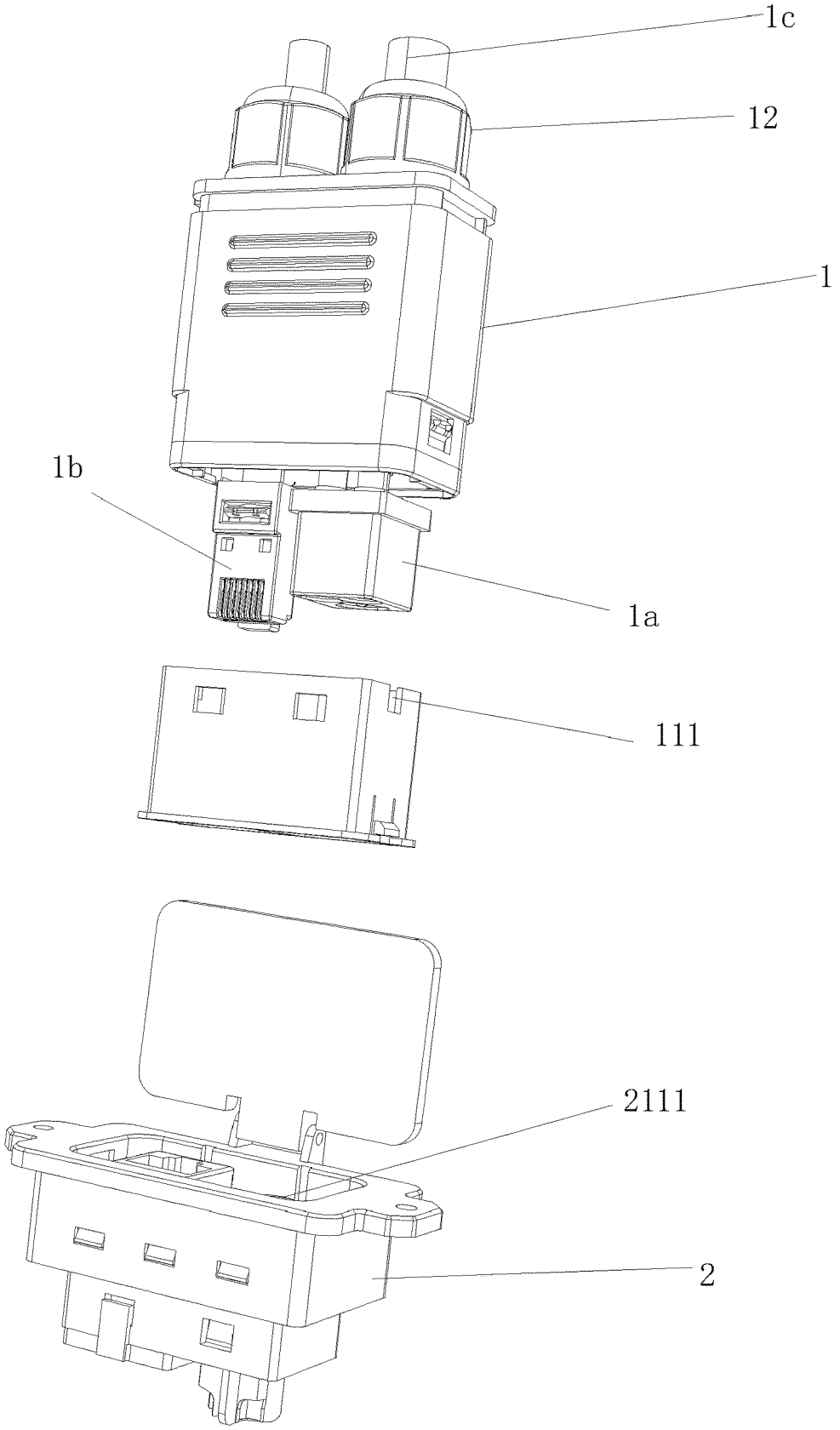
FIG. 6 is a schematic mounting illustration of a plug core of the safe electrical connector having replaceable interface according to the present invention.
Figure 7:
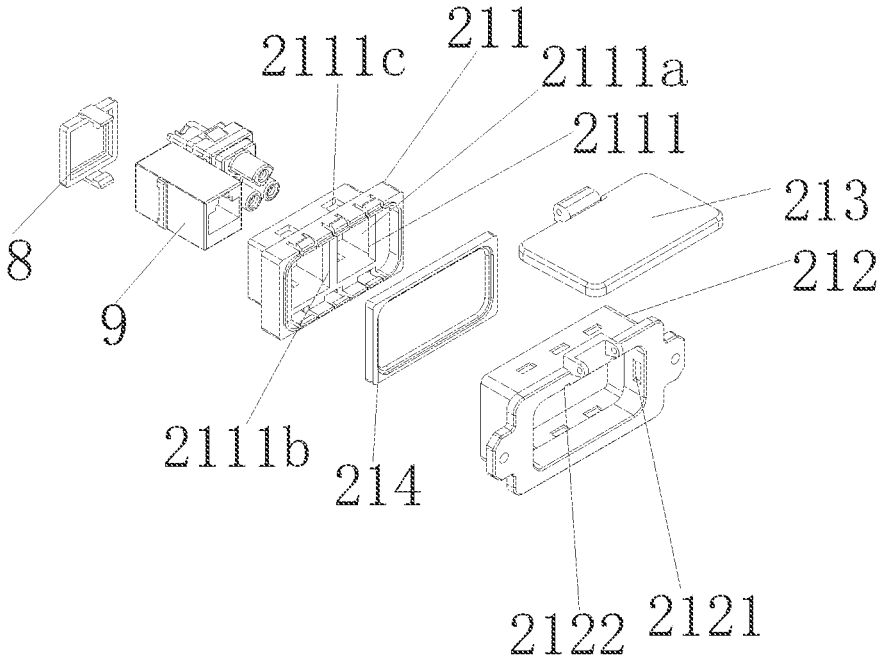
FIG. 7 is an exploded schematic illustration of the socket of the safe electrical connector having replaceable interface according to the present invention.
Figure 8:
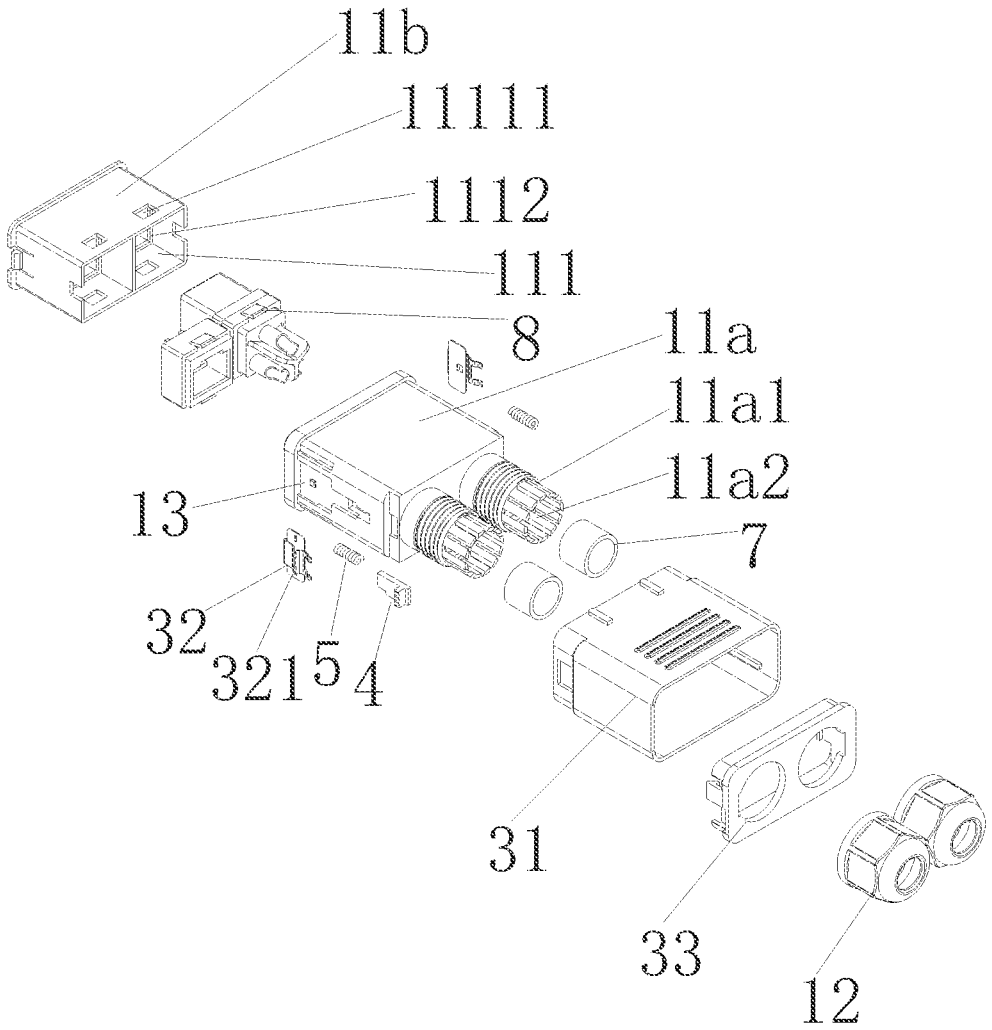
FIG. 8 is an exploded schematic illustration of the plug of the safe electrical connector plug having replaceable interface according to the present invention.
Figure 9:
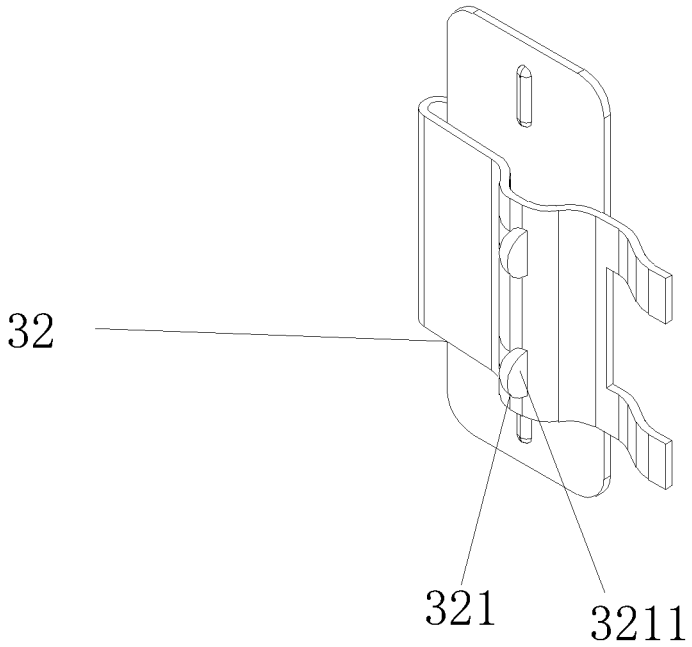
FIG. 9 is a schematic illustration of an elastic clamping body of the safe electrical connector having replaceable interface according to the present invention.

The technical solution of the present invention is as follows:

As shown in FIGS. 1-9, a safe electrical connector that has a replaceable interface, the electrical connector includes a plug assembly 1 and a socket assembly 2, the plug assembly 1 includes a plug housing 11 and a plug core connecting wire fixing body 12, and two plug core accommodating cavities 111 are provided in the plug housing 11. Three, four, five or more plug core accommodating cavities 111 may be provided according to the needs. Existing plug cores, such as a power connecting terminal 1*a* and a network plug 1*b* shown in the figures, are detachably mounted in the plug core accommodating cavities 111, the connecting wire 1*c* of the existing plug cores penetrates from an upper end of the plug housing 11, and the connecting wire 1*c* is fixed to the plug housing 11 by the plug core connecting wire fixing body 12. The socket assembly 2 includes a socket housing 21, the socket housing 21 is internally provided with plug core female end accommodating cavities 2111, and the plug core female end accommodating cavities 2111 are adapted to the plug core accommodating cavities 111. Different plug cores can be replaced and mounted in the plug core accommodating cavities 111, so that users can replace different plug cores for use. With two or more plug core accommodating cavities 111, a plurality of connecting terminals of some electrical appliances that require multiple connection terminals are integrated to one plug, which improves operation efficiency and reduces error rate.

The electrical connector further includes a plug and unplug clamping assembly 3, the socket housing 2 is provided with a clamping position 2121, the plug and unplug clamping assembly 3 is mounted on the plug housing 1, and the plug and unplug clamping assembly 3 is clamped in the clamping position 2121.

The plug and unplug clamping assembly 3 includes a hand grip 31 and an elastic clamping body 32, the elastic clamping body 32 is provided with a clamping projection 321, a right end surface of the clamping projection 321 is provided with a clamping plane 3211, the clamping projection 321 is clamped in the clamping position 2121, the clamping plane 3211 is affixed to an inner side of the clamping position 2121, the plug housing 1 is provided with a clamping body accommodating groove 13, the elastic clamping body 32 is mounted in the clamping body accommodating groove 13, and the clamping projection 321 is pressed into the clamping body accommodating groove 13 when the hand grip 31 moves upward. The clamping plane 3211 avoids separation of the plug and the socket when pulling, and also avoids easy disconnection by non-professionals.

The plug and unplug clamping assembly 3 further includes a limit upper cover 33, and the limit upper cover 33 is connected to the upper end of the plug housing 11.

The electrical connector is further provided with a wrong-pulling prevention assembly 4, the wrong-pulling prevention assembly 4 is arranged on the plug and unplug clamping assembly 3, the wrong-pulling prevention assembly 4 and the hand grip 31 are movable, the limit upper cover 33 is provided with a pull-out position 311, and when the wrong-pulling prevention assembly 4 is moved to the pull-out position 311, the hand grip 31 can be pulled up. During the implementation of this technical solution, the limit upper cover 33 may not be used, but the wrong pulling prevention assembly 4 is used for limiting, the pull-out position 311 is arranged on the hand grip 31, and the hand grip 31 can be pulled out when the wrong-pulling prevention assembly 4 is moved to the pull-out position 311.

An inner side of the hand grip 31 is provided with an anti-detaching oblique sheet 312, a lower end of the anti-detaching oblique sheet 312 is connected to a lower part of the hand grip 31, the anti-detaching oblique sheet 312 is arranged obliquely upward, the plug housing 1 is provided with an anti-detaching groove 14, and an upper end of the anti-detaching oblique sheet 312 is movable up and down in the anti-detaching groove 14. The electrical connector is further provided with a return spring 5, one end of the return spring 5 abuts against a side of the anti-detaching groove 14, and the other end abuts against the lower end of the anti-detaching oblique sheet 312.

The electrical connector further includes a fool-proof protruding strip 6, the fool-proof protruding strip 6 is arranged on the hand grip 31, or the fool-proof protruding strip 6 is arranged at an inner lower part of the plug housing 11, a fool-proof groove 2122 is provided in the socket housing 21, and after the plug assembly 1 and the socket assembly 2 are connected, the fool-proof protruding strip 6 falls in the fool-proof groove 2122.

The plug housing 11 includes a plug housing body 11*a* and a plug core mounting seat 11*b*, the plug core mounting seat 11*b* is mounted at a lower part of the plug housing body 11*a*, and the plug core accommodating cavities 111 are provided in the plug core mounting seat 11*b*.

The plug core accommodating cavity 111 includes a plug core surrounding edge 1111 and a plug core positioning convex edge 1112, the plug core positioning convex edge 1112 is located at a middle part of the plug core surrounding edge 1111, and an upper part of the plug core positioning convex edge 1112 is provided with a plug core fixing hole 11111. In order to use cooperatively, an existing frame clasp 8 is fastened above an existing terminal, and the frame clasp 8 is clamped on the plug core fixing hole 11111 by means of internal fastening or external fastening.

An upper end of the plug housing body 11*a* is provided with a connecting wire passing post 11*a*1, a middle part of the connecting wire passing post 11*a*1 is provided with a connecting wire passing hole 11*a*2; the electrical connector is further provided with a sealing ring 7, the sealing ring 7 is placed in the connecting wire passing hole 11*a*2, the plug core connecting wire fixing body 12 is mounted on an end of the connecting wire passing post 11*a*2, and the plug core connecting wire fixing body 12 presses the sealing ring 7.

The socket housing 21 includes a plug core female end mounting seat 211 and a fixed seat 212, the plug core female end accommodating cavities 2111 are provided in the plug core female end mounting seat 211, the plug core female end mounting seat 211 is mounted on the fixed seat 212, the fixed seat 212 is used to mount the plug core female end mounting seat 211 on an existing device, the plug core female end accommodating cavity 2111 includes a plug core female end surrounding edge 2111*a* and a plug core female end positioning edge 2111*b*, the plug core female end positioning edge 2111*b* is arranged on the plug core female end surrounding edge 2111*a*, the plug core female end surrounding edge 2111*a* is provided with a female end fixing hole 2111*c*, and an existing plug core female end 9 is clamped on the female end fixing hole 2111*c* with the existing frame clasp 8 by means of internal fastening or external fastening.

The socket housing 21 further includes a flip cover 213, and the flip cover 213 is connected to the fixed seat 212 by a shaft. After the flip cover 213 is turned over, the flip cover 213 covers an upper surface of the fixed seat 212.

In order to further proof water, a rubber pad 214 is arranged at the position where the plug core mounting seat 211 and the fixed seat 212 are connected.

The advantages of the present invention are:

Compared with the prior art, in the present invention, the plug core accommodating cavities are provided in the plug assembly, and different plug cores can be mounted in the plug core accommodating cavities, so that users can replace different plug cores for use; the electrical connector has high versatility, the model does not need to be separately confirmed again when in use, connectors of specific models do not need to be customized, and different electrical appliances can be connected according to the needs during processing and production. With the plurality of plug core accommodating cavities, a plurality of connecting terminals of some electrical appliances that require multiple connection terminals are integrated to one plug, which improves operation efficiency and reduces error rate.

The preferred embodiments of the present invention are listed above, and are not used to limit the present invention. Any modification, equivalent replacement and improvement made within the spirit and principle of the present invention shall be included in the protection scope of the present invention.

The invention claimed is:

1. A safe electrical connector having replaceable interface, the electrical connector comprises a plug assembly and a socket assembly, wherein:

the plug assembly comprises a plug housing and a plug core connecting wire fixing body, the plug housing is internally provided with a plurality of plug core accommodating cavities; an existing plug core may be detachably mounted inside of a plug core accommodating cavity, and a connecting wire of the existing plug core penetrates from an upper end of the plug housing, and the plug core connecting wire fixing body fixes the connecting wire on the plug housing; and the socket assembly comprises a socket housing, the socket housing is internally provided with plug core female end accommodating cavities, and the plug core female end accommodating cavities are configurated to mate with the plug core accommodating cavities;

wherein the electrical connector further comprises a plug and unplug clamping assembly, the socket housing is provided with a clamping position, the plug and unplug clamping assembly is mounted on the plug housing, and the plug and unplug clamping assembly is clamped in the clamping position;

wherein the plug and unplug clamping assembly comprises a hand grip and an elastic clamping body, the elastic clamping body is provided with a clamping projection, a right end surface of the clamping projection is provided with a clamping plane, the clamping projection is clamped in the clamping position, the clamping plane is affixed to an inner side of the clamping position; the plug housing is provided with a clamping body accommodating groove, the elastic clamping body is mounted in the clamping body accommodating groove, and the clamping projection is pressed into the clamping body accommodating groove when the hand grip moves upward;

wherein the electrical connector further comprises a wrong-pulling prevention assembly, the wrong-pulling prevention assembly is arranged on the plug and unplug clamping assembly, the plug and unplug clamping assembly and the hand grip are movable, the hand grip is provided with a pull-out position, and when the wrong pulling prevention assembly is moved to the pull-out position, the hand grip can be pulled up.

2. The electrical connector according to claim 1, wherein an inner side of the hand grip is provided with an anti-detaching oblique sheet, a lower end of the anti-detaching oblique sheet is connected to a lower part of the hand grip, the anti-detaching oblique sheet is arranged obliquely upward, the plug housing is provided with an anti-detaching groove, and an upper end of the anti-detaching oblique sheet is movable up and down in the anti-detaching groove.

3. The electrical connector according to claim 1, wherein the electrical connector further comprises a fool-proof protruding strip, the fool-proof protruding strip is arranged on the plug housing, or the fool-proof protruding strip is arranged on the hand grip, the socket housing is provided with a fool-proof groove, and the fool-proof protruding strip falls in the fool-proof groove.

4. The electrical connector according to claim 1, wherein the plug housing comprises a plug housing body and a plug core mounting seat, the plug core mounting seat is mounted at a lower part of the plug housing body, and the plug core accommodating cavities are provided in the plug core mounting seat.

5. The electrical connector according to claim 4, wherein the plug core accommodating cavity comprises a plug core surrounding edge and a plug core positioning convex edge, the plug core positioning convex edge is located at a middle part of the plug core surrounding edge, and an upper part of the plug core positioning convex edge is provided with a plug core fixing hole.

6. The electrical connector according to claim 1, wherein an upper end of the plug housing is provided with a connecting wire passing post, a middle part of the connecting wire passing post is provided with a connecting wire passing hole; the electrical connector is further provided with a sealing ring, the sealing ring is placed in the connecting wire passing hole, the plug core connecting wire fixing body is mounted on an end of the connecting wire passing post, and the plug core connecting wire fixing body presses the sealing ring.

7. The electrical connector according to claim 1, wherein the socket housing comprises a fixed seat and a plug core female end mounting seat, the plug core female end accommodating cavities are provided in the plug core female end mounting seat, the plug core female end mounting seat is mounted on the fixed seat, the fixed seat is used to mount the plug core female end mounting seat on an existing device, the plug core female end accommodating cavity comprises a plug core female end surrounding edge and a plug core female end positioning edge, the plug core female end positioning edge is arranged on the plug core female end surrounding edge, the plug core female end surrounding edge is provided with a female end fixing hole, and an existing plug core female end is clamped on the female end fixing hole.

8. The electrical connector according to claim 1, wherein the plug housing comprises a plug housing body and a plug core mounting seat, the plug core mounting seat is mounted at a lower part of the plug housing body, and the plug core accommodating cavities are provided in the plug core mounting seat.

9. The electrical connector according to claim 1, wherein the plug housing comprises a plug housing body and a plug core mounting seat, the plug core mounting seat is mounted at a lower part of the plug housing body, and the plug core accommodating cavities are provided in the plug core mounting seat.

10. The electrical connector according to claim 1, wherein the plug housing comprises a plug housing body and a plug core mounting seat, the plug core mounting seat is mounted at a lower part of the plug housing body, and the plug core accommodating cavities are provided in the plug core mounting seat.

11. The electrical connector according to claim 1, wherein an upper end of the plug housing is provided with a connecting wire passing post, a middle part of the connecting wire passing post is provided with a connecting wire passing hole; the electrical connector is further provided with a sealing ring, the sealing ring is placed in the connecting wire passing hole, the plug core connecting wire fixing body is mounted on an end of the connecting wire passing post, and the plug core connecting wire fixing body presses the sealing ring.

12. The electrical connector according to claim 1, wherein an upper end of the plug housing is provided with a connecting wire passing post, a middle part of the connecting wire passing post is provided with a connecting wire passing hole; the electrical connector is further provided with a sealing ring, the sealing ring is placed in the connecting wire passing hole, the plug core connecting wire fixing body is mounted on an end of the connecting wire passing post, and the plug core connecting wire fixing body presses the sealing ring.

13. The electrical connector according to claim 1, wherein an upper end of the plug housing is provided with a connecting wire passing post, a middle part of the connecting wire passing post is provided with a connecting wire passing hole; the electrical connector is further provided with a sealing ring, the sealing ring is placed in the connecting wire passing hole, the plug core connecting wire fixing body is mounted on an end of the connecting wire passing post, and the plug core connecting wire fixing body presses the sealing ring.

14. The electrical connector according to claim 1, wherein the socket housing comprises a fixed seat and a plug core female end mounting seat, the plug core female end accommodating cavities are provided in the plug core female end mounting seat, the plug core female end mounting seat is mounted on the fixed seat, the fixed seat is used to mount the plug core female end mounting seat on an existing device, the plug core female end accommodating cavity comprises a plug core female end surrounding edge and a plug core female end positioning edge, the plug core female end positioning edge is arranged on the plug core female end surrounding edge, the plug core female end surrounding edge is provided with a female end fixing hole, and an existing plug core female end is clamped on the female end fixing hole.

15. The electrical connector according to claim 1, wherein the socket housing comprises a fixed seat and a plug core female end mounting seat, the plug core female end accommodating cavities are provided in the plug core female end mounting seat, the plug core female end mounting seat is mounted on the fixed seat, the fixed seat is used to mount the plug core female end mounting seat on an existing device, the plug core female end accommodating cavity comprises a plug core female end surrounding edge and a plug core female end positioning edge, the plug core female end positioning edge is arranged on the plug core female end surrounding edge, the plug core female end surrounding edge is provided with a female end fixing hole, and an existing plug core female end is clamped on the female end fixing hole.

16. The electrical connector according to claim 1, wherein the socket housing comprises a fixed seat and a plug core female end mounting seat, the plug core female end accommodating cavities are provided in the plug core female end mounting seat, the plug core female end mounting seat is mounted on the fixed seat, the fixed seat is used to mount the plug core female end mounting seat on an existing device, the plug core female end accommodating cavity comprises a plug core female end surrounding edge and a plug core female end positioning edge, the plug core female end positioning edge is arranged on the plug core female end surrounding edge, the plug core female end surrounding edge is provided with a female end fixing hole, and an existing plug core female end is clamped on the female end fixing hole.

* * * * *